US011289784B2

(12) United States Patent
Wrigley et al.

(10) Patent No.: US 11,289,784 B2
(45) Date of Patent: Mar. 29, 2022

(54) MULTIPACTION-PROOF WAVEGUIDE FILTER

(71) Applicant: LOCKHEED MARTIN CORPORATION, Bethesda, MD (US)

(72) Inventors: Jason Stewart Wrigley, Littleton, CO (US); Andrew Jason Kee, Arvada, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 16/926,560

(22) Filed: Jul. 10, 2020

(65) Prior Publication Data

US 2022/0013878 A1 Jan. 13, 2022

(51) Int. Cl.

*H01P 1/211* (2006.01)
*H01P 1/207* (2006.01)
*H01P 1/209* (2006.01)

(52) U.S. Cl.

CPC ..... *H01P 1/211* (2013.01); *H01P 1/209* (2013.01)

(58) Field of Classification Search

CPC ..... H01P 1/207; H01P 1/211; H01P 1/213; H01P 1/209; H01P 3/123

See application file for complete search history.

(56) References Cited

U.S. PATENT DOCUMENTS 3,224,004 A * 12/1965 Barthez ..... H01Q 13/22 343/771
3,597,710 A * 8/1971 Levy ..... H01P 1/211 333/210
4,697,272 A * 9/1987 Harvey ..... H01S 3/0903 372/108
4,970,522 A 11/1990 Niman
6,232,853 B1 5/2001 Goulouev
6,559,742 B2 * 5/2003 Fiedziuszko ..... H01P 3/14 333/241
6,750,735 B1 * 6/2004 Bertin ..... H01P 1/173 333/208
9,991,677 B2 * 6/2018 Briggs ..... H01S 5/125
2004/0233119 A1 11/2004 Chandler
2007/0024394 A1 * 2/2007 Sorolla ..... H01P 1/207 333/135
2010/0308938 A1 * 12/2010 Arregui Padilla ..... H01P 1/211 333/211

FOREIGN PATENT DOCUMENTS

EP 3477765 A1 5/2019

OTHER PUBLICATIONS

Olstad et al., CW Operation of Corrugated Waveguide Transmission Lines for ITER ECH and CD System, Research Gate, 228681519, Jan. 2007, 12 pages.*

International Search Report dated Oct. 20, 2021 in International Application No. PCT/US2021/040731.

* cited by examiner

*Primary Examiner* — Dean O Takaoka

(74) *Attorney, Agent, or Firm* — Morgan, Lewis & Bockius LLP

(57) ABSTRACT

A multipaction-proof waveguide filter includes a main cavity and a number of corrugations extending from the main cavity. The main cavity includes corrugation interconnect regions between the plurality of corrugations. The corrugation interconnect regions include sloped surfaces, and the corrugations include flared nonparallel sidewalk. Due to the introduced sloped surfaces and flares, an increased Q is achieved, improved roll off is observed and multipaction risks are mitigated.

18 Claims, 8 Drawing Sheets

| Power(W) | Order |
|---|---|
| 500 | No break |
| 1000 | No break |
| 2000 | No break |
| 4000 | No break |
| 8000 | No break |
| 16000 | No break |
| 32000 | No break |
| 64000 | No break |
| 128000 | No break |
| 256000 | No break |
| 512000 | No break |
| 1e6 | No break |

MULTIPACTION-PROOF WAVEGUIDE FILTER

STATEMENT REGARDING FEDERALLY SPONSORED RESEARCH OR DEVELOPMENT

Not applicable.

FIELD OF THE INVENTION

The present invention generally relates to communication systems and, more particularly, to a multipaction-proof waveguide filter.

BACKGROUND

Traditional corrugated waveguide filters may contain high and low-wave impedance sections that can form a low-pass filter. These traditional corrugated waveguide filters often suffer from multipaction breakdown at lower-than-desired power levels. The multipaction breakdown phenomena is most likely to occur first (with increasing power) in regions of the waveguide filter, which contain parallel plates, high voltages and small gaps. The multipaction-breakdown phenomena is initiated when electrons emitted from a first cavity surface of the waveguide collide with a parallel second cavity surface and cause secondary electron emission, which in turn causes emission of additional secondary electrons. The multiplication process can quickly grow into an avalanche breakdown, which can physically damage the waveguide and significantly disrupt the communication system.

Traditional corrugated filter topologies often contain longer and wider corrugations in order to increase the multipaction margins against the desired input power levels. The filter designer must iteratively increase gap sizes and stub lengths while monitoring the multipaction threshold via simulation. This iterative process can trade performance. For example, the resulting higher-power waveguide filter will have a poor reflection (dispersive) in the rejection band which results in a low achievable bandwidth when forming a diplexer. Similar bandwidth complications arise when trying to form a multiband quadrature junction or manifold. Further, the traditional waveguide cavity structure includes many regions with parallel plates that present opportunities for secondary emission and creation of resonance phenomena. The resonance phenomena leads to multipaction breakdown, which can render the communication channel useless and can physically damage the waveguide cavity.

SUMMARY

According to various aspects of the subject technology, methods and configurations are disclosed for providing a multipaction-proof waveguide filter. The disclosed solution removes parallel plates from the structural design of the waveguide filter to mitigate multipaction and its damaging effect.

In one or more aspects, a multipaction-proof waveguide filter includes a main cavity and a number of corrugations extending from the main cavity. The main cavity includes corrugation interconnect regions between the plurality of corrugations. The corrugation interconnect regions include sloped surfaces, and the corrugations include nonparallel sidewalls.

In other aspects, a waveguide filter includes a main cavity, two waveguide interfaces and a main cavity between two waveguide interfaces. A number of corrugations having different heights flare out of the main cavity. Corrugation interconnect regions of the main cavity between the plurality of corrugations include inward-sloped surfaces, and at least two sidewalls of the plurality of corrugations are nonparallel.

In yet other aspects, a method includes fabricating a first half-structure including a main cavity and a plurality of corrugations and fabricating a second half-structure similar to the first half-structure. The first half-structure is coupled to the second half-structure to form a multipaction-proof waveguide filter. The main cavity includes corrugation interconnect regions between the corrugations. The corrugation interconnect regions include sloped surfaces, and the corrugations include nonparallel sidewalls.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure and the advantages thereof, reference is now made to the following descriptions to be taken in conjunction with the accompanying drawings describing specific aspects of the disclosure, wherein.

DETAILED DESCRIPTION

Figure 1:
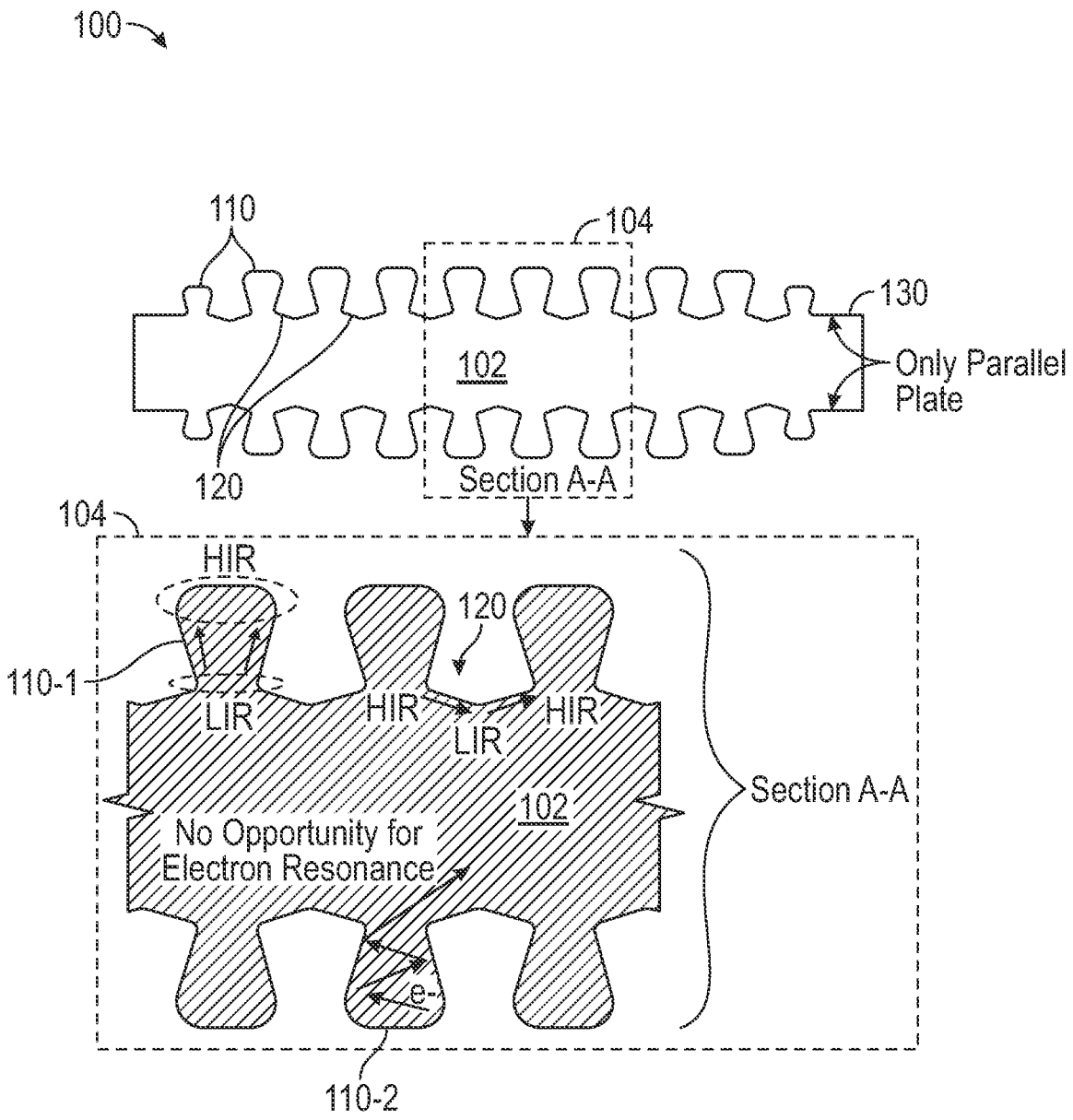
FIG. 1 is a schematic diagram illustrating a cross-sectional view of an example of a multipaction-proof waveguide filter, according to certain aspects of the disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block-diagram form in order to avoid obscuring the concepts of the subject technolgy.

According to various aspects of the subject technology, methods and configurations for providing a multipaction-proof waveguide filter (also known as cavity filter) are described. The subject technology improves the structural design of the waveguide filter by eliminating parallel plates from the design to alleviate multipaction breakdown. The multipaction-breakdown process can be initiated when electrons emitted from a first cavity surface of the waveguide due to high-electromagnetic (EM) fields collide with a parallel second cavity surface and cause secondary electron emission. Under the influence of the high-EM field, these secondary electrons can in turn cause emission of additional secondary electrons, which quickly grow into an avalanche breakdown leading to physical damage of the waveguide.

The subject technology greatly increases the power handling of the waveguide filter when compared to the traditional approach without increasing the filter length, cost or manufacturing complexity, Additionally, due to a higher-achieved cavity Q, a better roll off is observed when compared to a same-size and same-number-of-corrugations traditional approach. The existing waveguide filters are silver-plated to increase multipaction margin. The disclosed approach can significantly increase the multipaction margin at a much lower cost, and can achieve suitable margins even in a bare aluminum structure. Silver-plating the disclosed waveguide filter would of course significantly increase power handling, improve insertion loss and decrease the amount of external heat-dissipation structure needed. It should be noted that for a waveguide filter to be considered multipaction proofed its waveguide interfaces, which contain parallel plates by governed standards, must multipact before the filter interior. These parallel plate interfaces (e.g. WR75) are industry standards and cannot be tuned or adjusted by the filter designer.

The subject solution introduces slopes to the cavity structure of the traditionally parallel surfaces in order to create paths for secondarily emitted electrons to escape resonance. The created slopes in the cavity of the waveguide filter of the subject technology facilitate drifting of the secondarily emitted electrons away from another cavity surface and exiting the cavity structure without resonating to create a multipaction breakdown. The disclosed waveguide filter can handle ten times the power without initiation of the multipaction effect and without trading performance or filter length. Further optimizing of the sloped sections of the cavity may permit electrons to escape the resonant phenomena more effectively.

FIG. 1 is a schematic diagram illustrating a cross-sectional view of an example of a multipaction-proof waveguide filter 100, according to certain aspects of the disclosure. The multipaction-proof waveguide filter 100 includes a main cavity 102, multiple (e.g., more than 2) corrugations 110, corrugation interconnects 120, and a waveguide interface 130. In the example embodiment shown in FIG. 1, the corrugations 110 flare out as they extend away from the main cavity 102 of the multipaction-proof waveguide filter 100. More structural details of the multipaction-proof waveguide filter 100 are depicted in an expanded view of the section 104 (section A-A). The expanded view of the section 104 shows each corrugation 110 (e.g., 110-1) starts with a low-impedance region (LIR) and ends with a high-impedance region (MR) as it extends away from the main cavity 102 and is structured so that there are no parallel plates in the corrugation 110 for electrons to resonate. For example, an electron (e-)generated in the corrugation 110 (e.g., 110-2 scatter a couple of times from the nonparallel sides of the corrugation 110-2 and eventually leave the corrugation 110-2 without multipaction and enter the main cavity 102 where there is no opportunity to cause electron resonance. In some implementations, the multipaction-proof waveguide filter 100 is made of aluminum and plated with silver, although other materials such as brass, invar and copper can also be used.

The other aspect of the subject technology is the structure of the corrugation interconnects 120, which starts from an MR at an end edge of a corrugation and slopes down to an LIR in the middle of the corrugation interconnects 120, and from there slopes up to an HIR at the beginning edge of the next corrugation. The slopes in the structure of the corrugation interconnects 120 remove parallel plates from the structure of the multipaction-proof waveguide filter 100, which prevents electrons from resonating and causing multipaction.

Figure 2A:
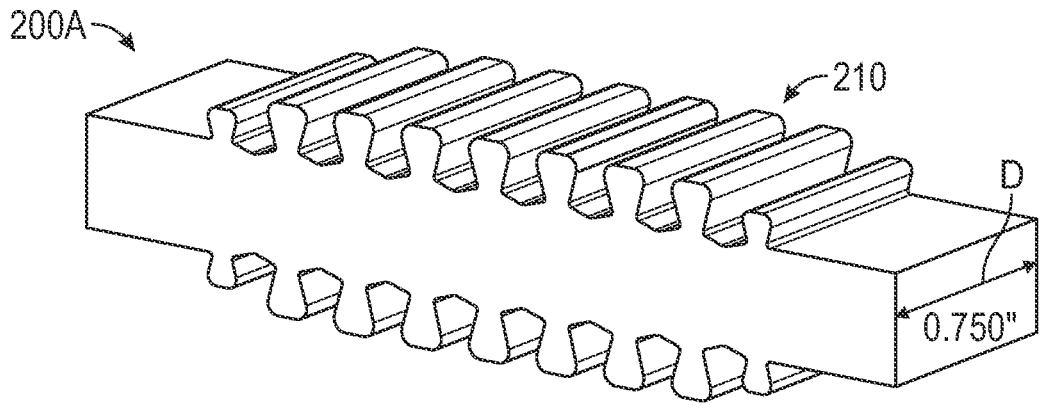
FIGS. 2A and 2B are schematic diagrams illustrating a perspective view and a cross-sectional view of a multipaction-proof waveguide filter, according to certain aspects of the disclosure.
Figure 2B:
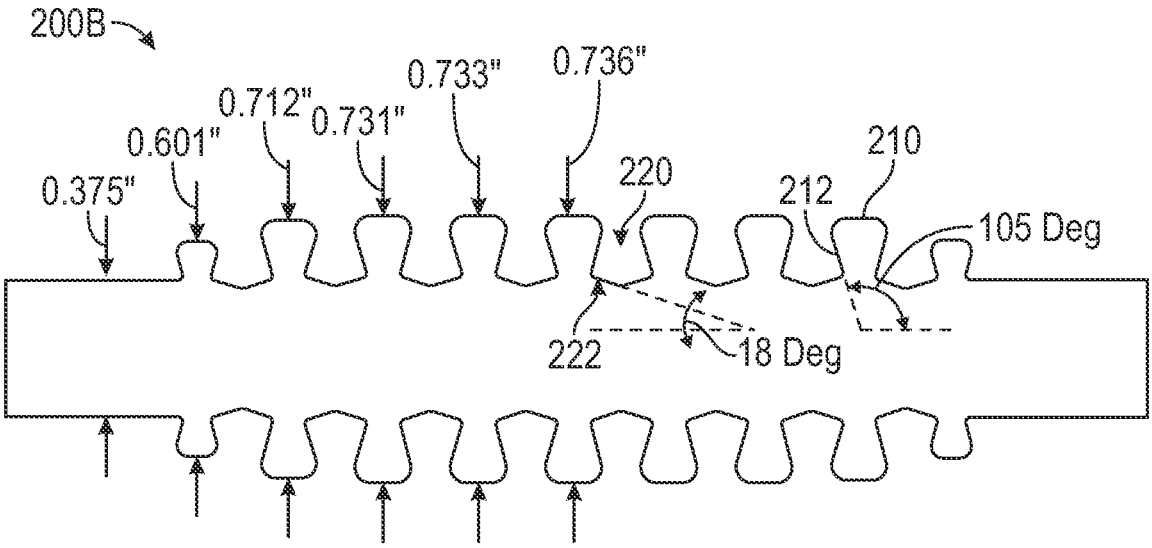

FIGS. 2A and 2B are schematic diagrams illustrating a perspective view 200A and a cross-sectional view 200B of a multipaction-proof waveguide filter 200, according to certain aspects of the disclosure. The perspective view 200A shows an example value of about 0.750 inches for the depth D of the multipaction-proof waveguide filter 210.

FIG. 2B is the cross-sectional view 200B of the multipaction-proof waveguide filter 200, showing exemplary values of the heights of corrugation regions, which increase monotonically toward the middle of the length of the multipaction-proof waveguide filter 200 and then decrease monotonically toward the end of the multipaction-proof waveguide filter 200. FIG. 2B further shows an example value of the slopes of the sidewalls of the corrugation 210 to be about 105 degrees with respect to the axis of the multipaction-proof waveguide filter 200. In the interconnect region 220, the example values of the slopes are shown to be about 18 degrees with respect to the axis of the multipaction-proof waveguide filter 200. In some aspects, other values of these slopes may also be used to prevent multipaction.

In one or more aspects, the multipaction-proof waveguide filter 200 can be built by joining two identical half-pieces, with each half-piece having a cross-section similar to the cross-sectional view 200B. Each half-piece can be fabricated by machining a metal piece, for example, made of aluminum, invar, brass or copper to create the main cavity and the corrugations, plated with a layer of silver and joined to form the multipaction-proof waveguide filter 200.

Figure 3:
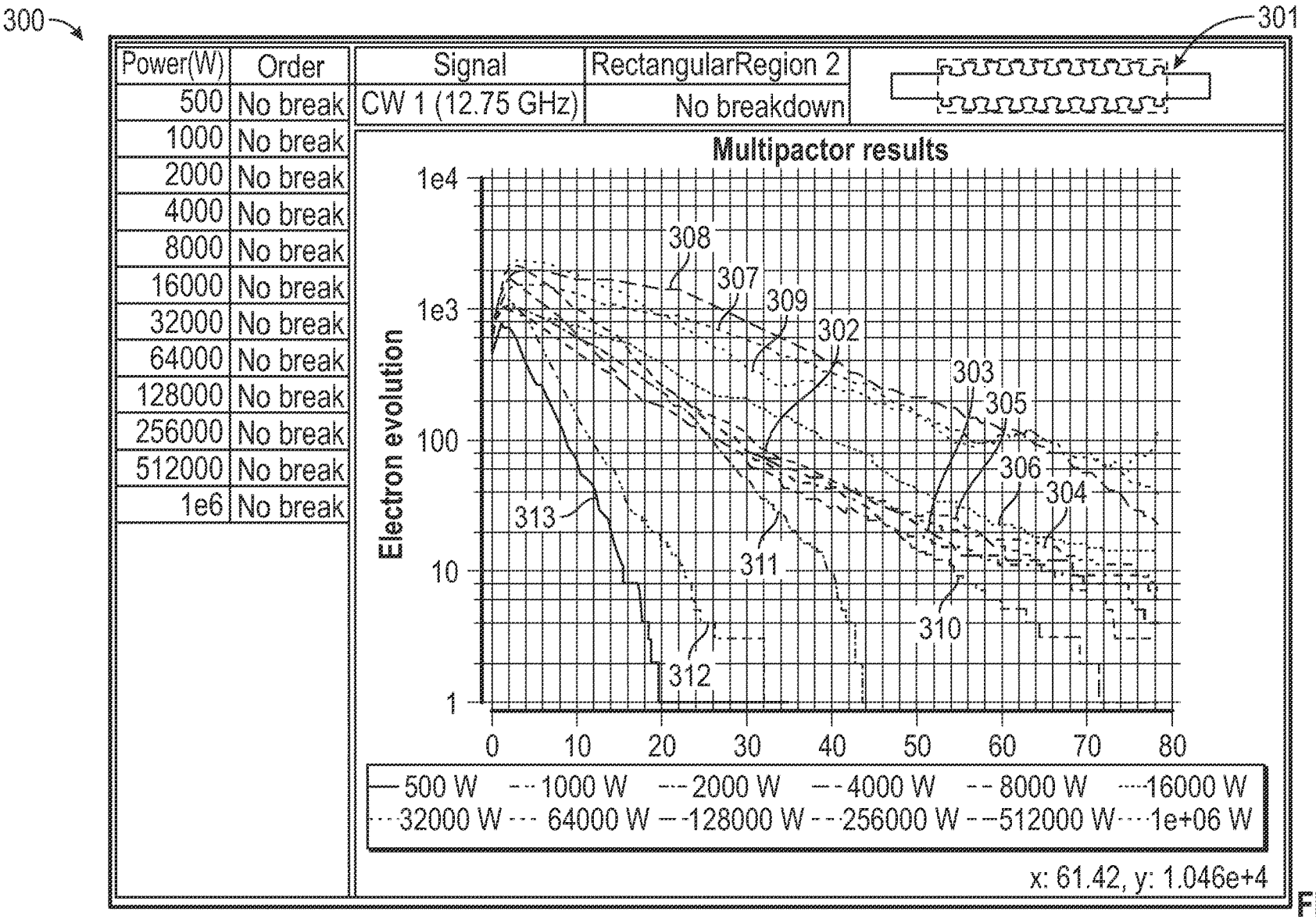
FIG. 3 is a chart illustrating simulation results depicting electron evolution versus time of an example of a multipaction-proof waveguide filter, according to certain aspects of the disclosure.

FIG. 3 is a chart 300 illustrating simulation results depicting electron evolution versus time of an example of a multipaction-proof waveguide filter 301, according to certain aspects of the disclosure. The chart 300 includes a number of plots showing simulation results for electron evolution (number of electrons) as a function of time (nanosecond) for a number of power levels applied to the corrugation region of a multipaction-proof waveguide filter 301 of the subject technology. The plots 302, 303, 304, 305, 306, 307, 308, 309, 310, 311, 312 and 313 correspond to power values of 500 W, 1,000 W, 000 W, 4,000 W, 8,000 W, 16,000 W, 32,000 W, 64,000 W, 128,000 W, 256,000 W, 512,000 W and 1,000,000 W, respectively. These simulation results show that no breakdown due to multipaction occurs at the power levels up to 1,000,000 W. The simulation is performed for a multipaction-proof waveguide filter made of aluminum and at a frequency of 12.75 GHz.

Figure 4:
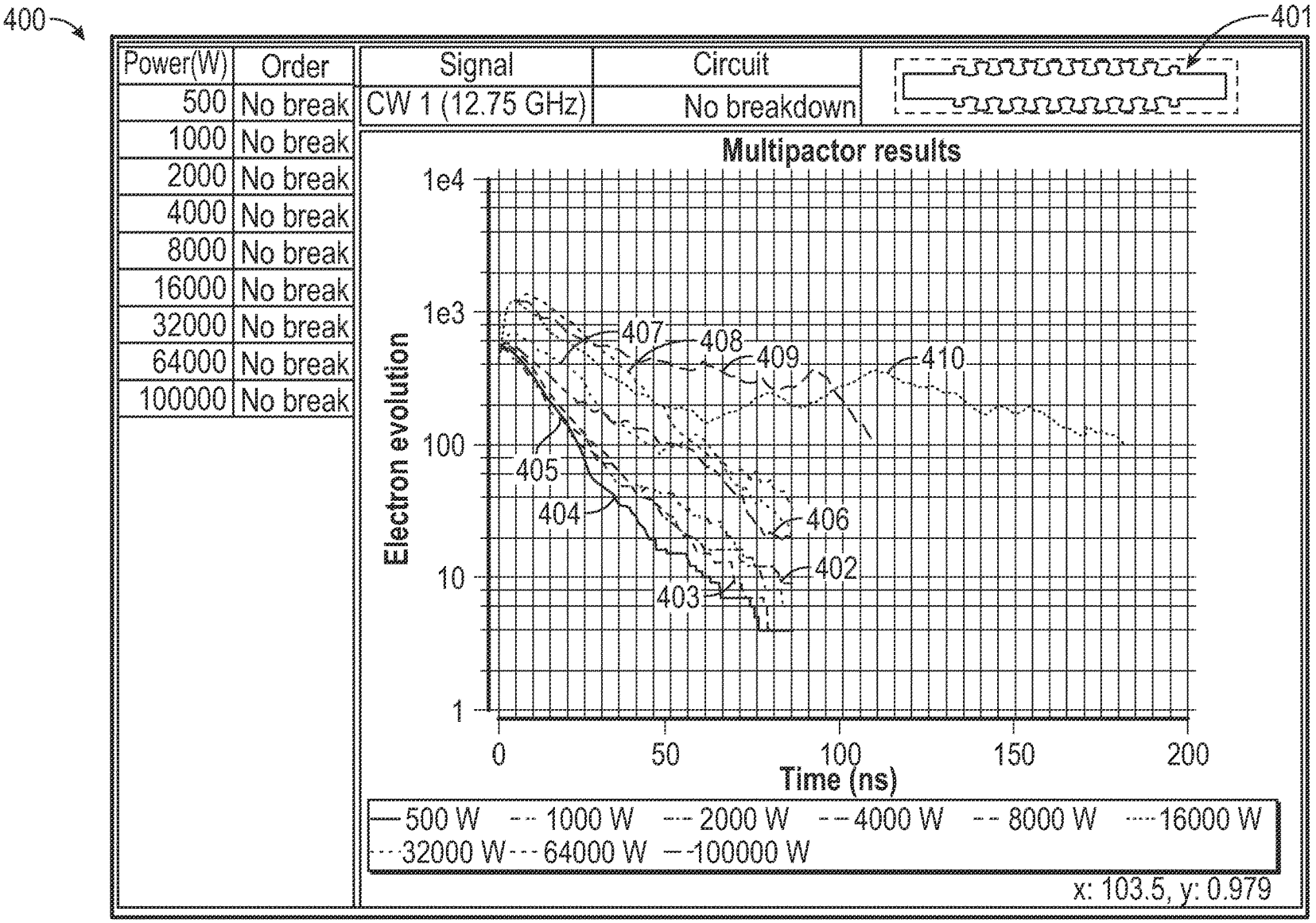
FIG. 4 is a chart illustrating simulation results depicting electron evolution versus time of an example of a multipaction-proof waveguide filter, according to certain aspects of the disclosure.

FIG. 4 is a chart illustrating simulation results depicting electron evolution versus time of an example of a multipaction-proof waveguide filter 401. The chart 400 includes a number of plots showing simulation results for electron evolution (number of electrons) as a function of time (nanosecond) for a number of power levels applied to the entire multipaction-proof waveguide filter 401, which is similar to the multipaction-proof waveguide filter 301 of FIG. 3. The plots 402, 403, 404, 405, 406, 407, 408, 409 and 410 correspond to power values of 500 W, 1,000 W, 2,000 W, 4,000 W, 8,000 W, 16,000 W, 32,000 W, 64,000 W and 100,000 W, respectively. These results show that no breakdown due to multipaction occurs at the power levels up to 100,000 W, which is significantly (10 times) lower compared to simulation results for the multipaction-proof waveguide filter 301 of FIG. 3, for which only the corrugation region was used for simulation. The simulation was performed at the same frequency of 12.75 GHz. The reason for the drastic change in the multipaction process threshold is the electron resonance in the parallel plates of the waveguide-interface region, which was not included in the simulation of the multipaction-proof waveguide filter 301 of FIG. 3.

Figure 5:
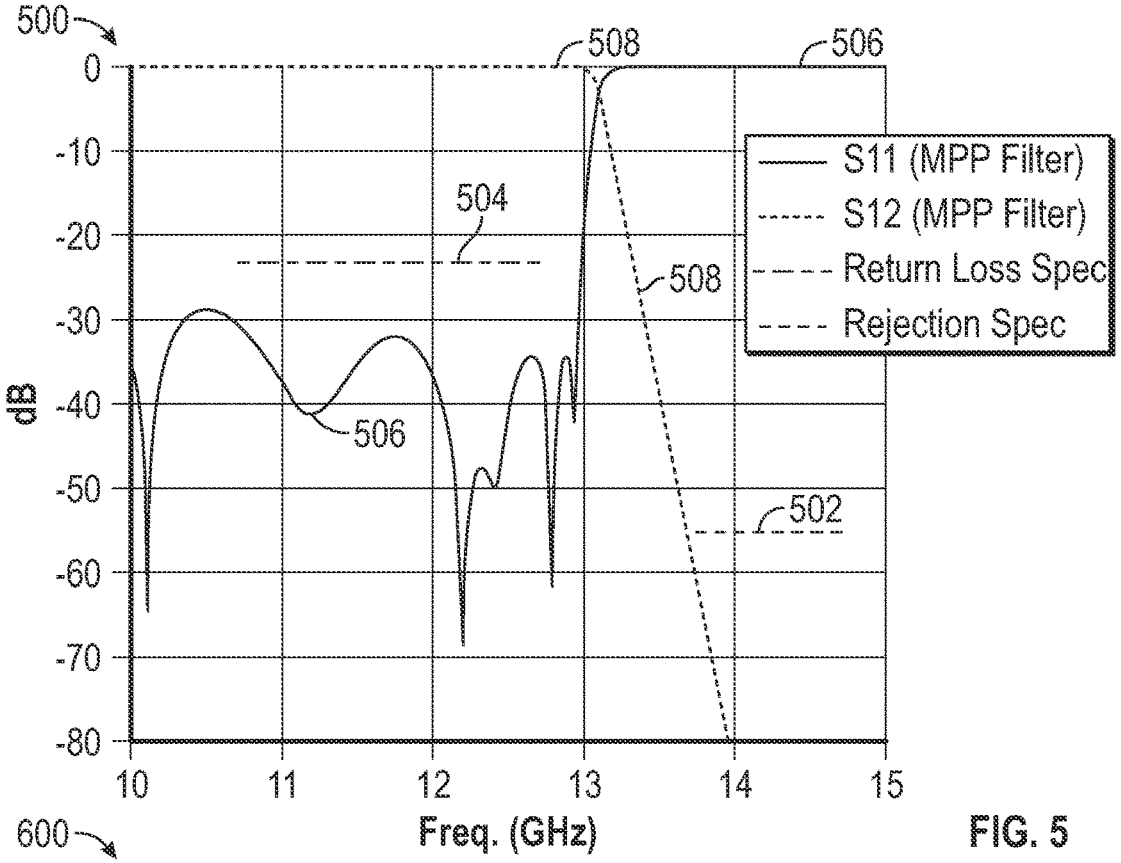
FIG. 5 is a chart illustrating performance plots depicting variations of the return loss and rejection parameters versus frequency of an example of a multipaction-proof waveguide filter, according to certain aspects of the disclosure.

FIG. 5 is a chart illustrating performance plots 506 and 508, respectively, depicting variations of the return loss and rejection parameters versus frequency of an example of a multipaction-proof waveguide filter, according to certain aspects of the disclosure. Plots 502 and 504 depict specification-defined values of return loss and rejection parameters. Plots 506 and 508 depict frequency variations of the return loss (S11) and rejection (S12) parameters of the multipaction-proof waveguide filter (e.g., 210 of FIG. 2A) of the subject technology. The values of the return loss (S11) and rejection (S12) parameters are consistent with the specification-defined values shown by plots 502 and 504 at frequencies below the design frequency of 12.75 GHz.

Figure 6:
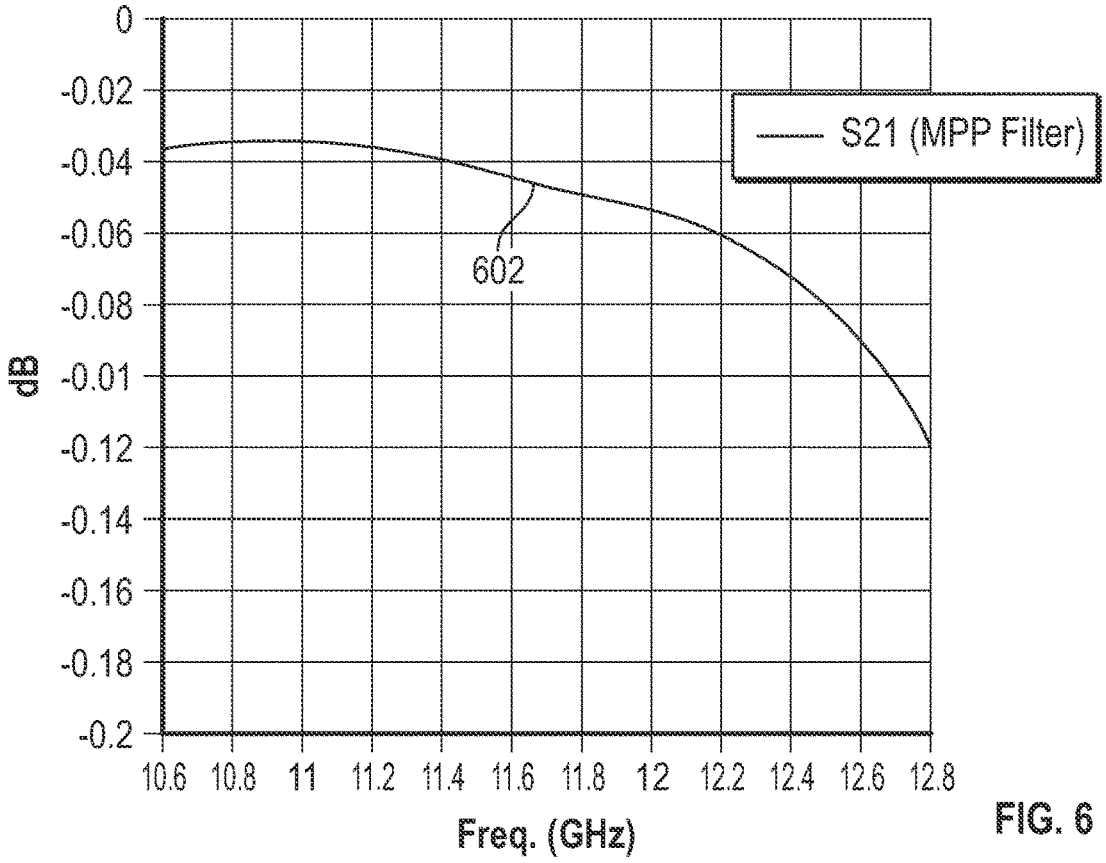
FIG. 6 is a chart illustrating a performance plot depicting variations of the insertion loss versus frequency of an example of a multipaction-proof waveguide filter, according to certain aspects of the disclosure.

FIG. 6 is a chart illustrating a performance plot 602 depicting variation of the insertion loss (S21) parameter versus frequency of an example of a multipaction-proof waveguide filter, according to certain aspects of the disclosure. The plot 602 shows that the insertion parameter of the multipaction-proof waveguide filter of the subject technology (e.g., 210 of FIG. 2A) is more than about −0.1 dB at frequencies below the design frequency of 12.75 GHz.

Figure 7:
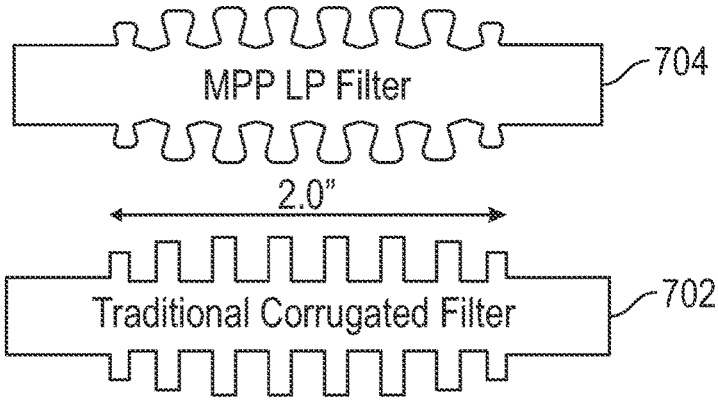
FIG. 7 is a chart illustrating performance plots depicting variations of scattering parameters versus frequency of an example of a traditional waveguide filter and a multipaction-proof waveguide filter of the subject technology.
Figure 7:
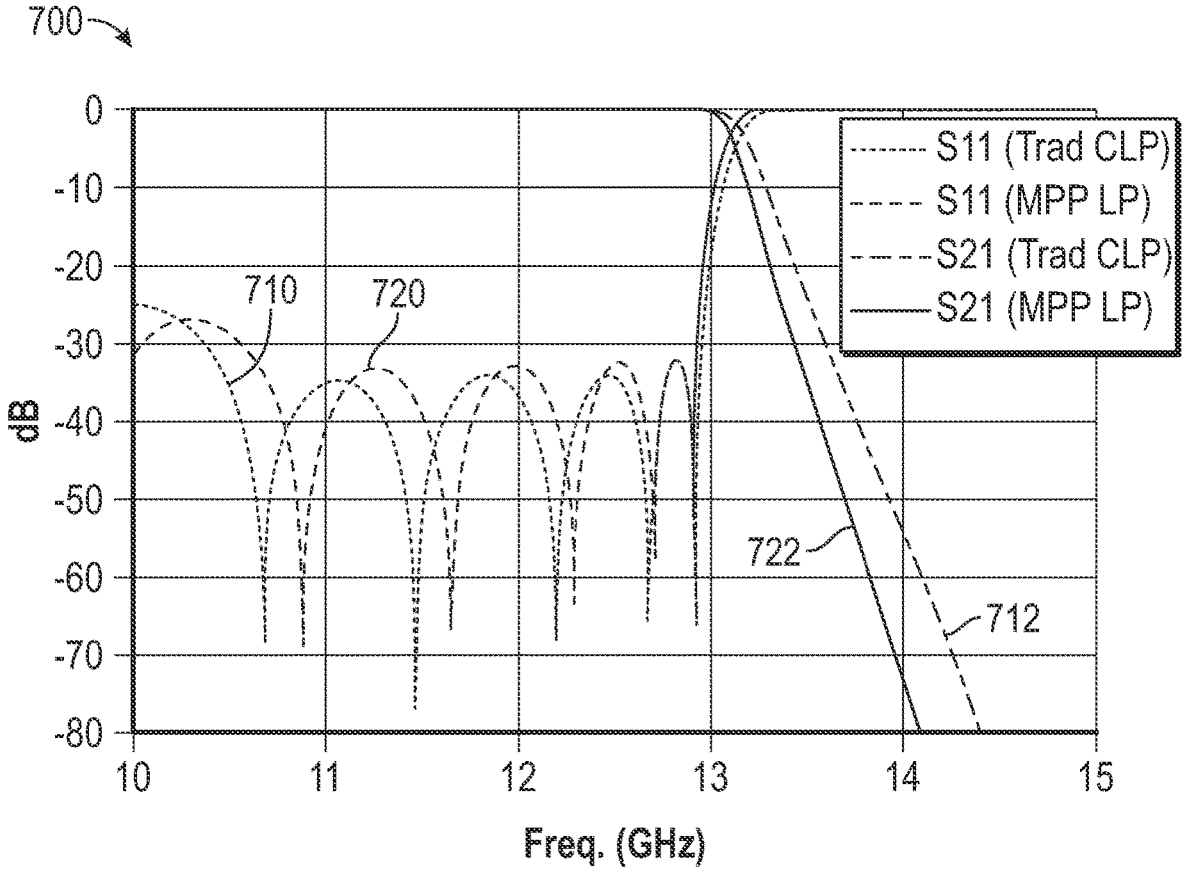

FIG. 7 is a chart illustrating performance plots depicting variations of scattering parameters versus frequency of an example of a traditional waveguide filter 702 and a multipaction-proof waveguide filter 704 of the subject technology. The traditional waveguide filter 702 and the multipaction-proof waveguide filter 704 have the same length and the same number (e.g., eight) of corrugations. Plot 710 shows the return loss (S11) parameter for the traditional waveguide filter 702, and plot 720 depicts the return loss (S11) parameter for the multipaction-proof waveguide filter 704, which shows improvement compared to the return loss (S11) parameter for the traditional waveguide filter 702 over the frequency range of interest (e.g., below 12.75 GHz). It is interesting to note that the higher rejections of the multipaction-proof waveguide filter 704 are achieved without increasing the waveguide filter length or mass because a higher cavity Q is achieved.

Plots 712 and 722 depict insertion loss (S21) parameters for the traditional waveguide filter 702 and multipaction-proof waveguide filter 704, respectively. The multipaction-proof waveguide filter 704 is seen to achieve a significant improvement in roll-off.

Figure 8:
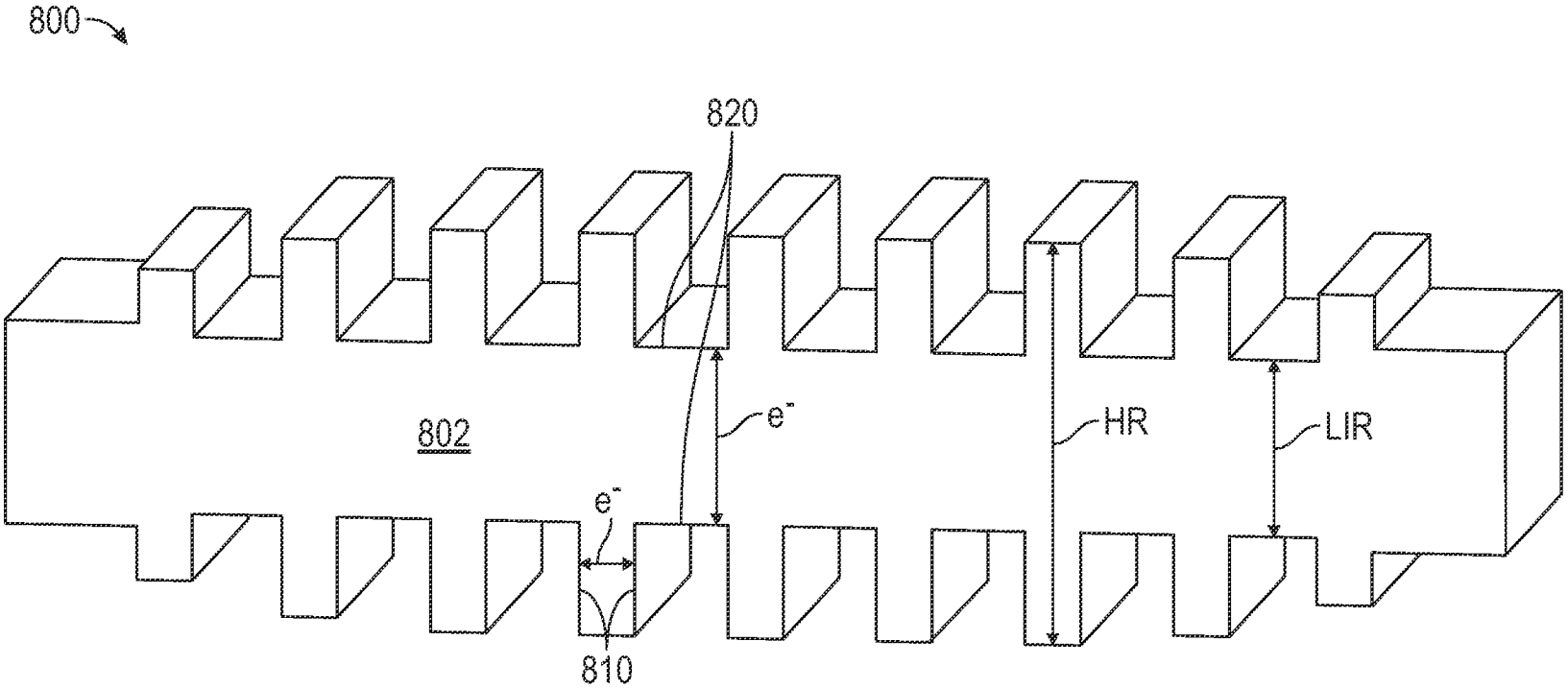
FIG. 8 is a schematic diagram illustrating multipaction in an example of a traditional waveguide filter, according to certain aspects of the disclosure.

FIG. 8 is a schematic diagram illustrating multipaction in an example of a traditional waveguide filter 800, according to certain aspects of the disclosure. As described above, the multipaction process is due to electron resonance in parallel plate regions of a waveguide. The traditional waveguide filter 800 provides ample opportunity for this process, as it includes many parallel plates. For example, all corrugations introduce parallel plates, such as side plates 810, between which the electron resonance can occur and lead to breakdown. Further, the main cavity 802 of the waveguide filter, in particular, in the corrugation interconnect regions, provides parallel plates 820, which are also prone to electron resonance and breakdown. The subject technology, as shown in FIG. 2B, removes the parallel plates in the corrugations as well as in the main cavity, as described above.

Figure 9:
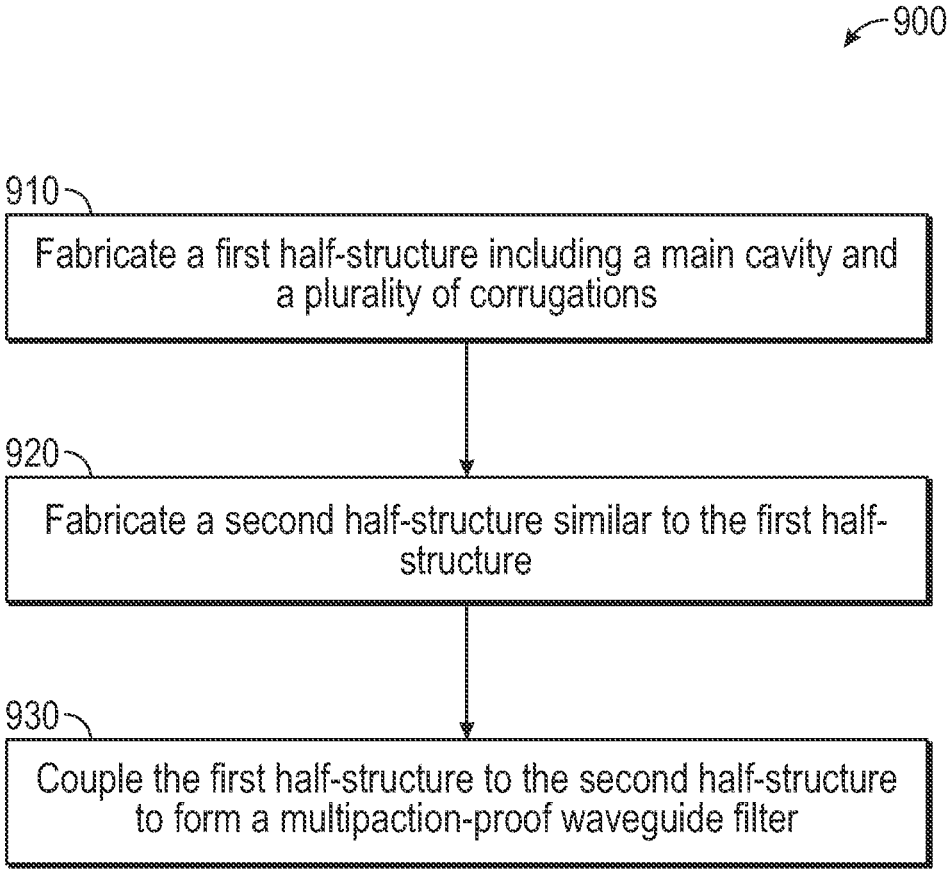
FIG. 9 is a flow diagram illustrating a method of providing a multipaction-proof waveguide filter, according to certain aspects of the disclosure.

FIG. 9 is a flow diagram illustrating a method 900 of providing a multipaction-proof waveguide filter (e.g., 210 of EEGs. 2A and 2B), according to certain aspects of the disclosure. The method 900 includes fabricating a first half-structure including a main cavity (e.g., 102 of FIG. 1) and a number of corrugations (e.g., 110 of FIG. 1) (910). The method 900 further includes fabricating a second half-structure similar to the first halt-structure (920). The first half-structure is coupled to the second half-structure to form a multipaction-proof waveguide filter (930). The main cavity includes corrugation interconnect regions (e.g., 120 of FIG. 1) between the corrugations. The corrugation interconnect regions include sloped surfaces (e.g., 222 of FIG. 2B), and the corrugations include nonparallel sidewalls (e.g., 212 of FIG. 2B).

In some aspects, the subject technology is related to methods and configurations for providing a multipaction-free filter waveguide. In other aspects, the subject technology may be used in various markets, including, for example and without limitation, communication systems markets.

Those of skill in the art would appreciate that the various illustrative blocks, modules, elements, components, methods, and algorithms described herein may be implemented as electronic hardware, computer software or a combination of both. To illustrate this interchangeability of hardware and software, various illustrative blocks, modules, elements, components, methods, and algorithms have been described above, generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified, and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patents or other documents that may be incorporated herein by reference, the definition that is consistent with this specification should be adopted.

What is claimed is:

1. A multipaction-proof waveguide filter, the waveguide filter comprising:

a main cavity; and a plurality of corrugations extending from the main cavity, wherein:

the main cavity includes corrugation interconnect regions between the plurality of corrugations;

the corrugation interconnect regions include sloped surfaces;

the plurality of corrugations comprise nonparallel sidewalls;

the sloped surfaces of the corrugation interconnect regions are at an angle with respect to an axis of the main cavity; and the angle is within a range of about 8-28 degrees.

2. The waveguide filter of claim 1, wherein each corrugation of the plurality of corrugations includes a high-impedance region (HIR) and a low-impedance region (LIR).

3. The waveguide filter of claim 2, wherein each corrugation of the plurality of corrugations flares out from the main cavity, and wherein the LIR is formed at an interface with the main cavity and the HIR is formed at an end of the corrugation.

4. The waveguide filter of claim 1, wherein corrugated sidewalls of the plurality of corrugations are at a first angle with respect to an axis of the main cavity, wherein the first angle is greater than 90 degrees and smaller than 180 degrees.

5. The waveguide filter of claim 1, wherein a count of the plurality of corrugations is greater than three, and wherein heights of the plurality of corrugations vary along a length of the main cavity and reach a maximum height at a midlength of the waveguide filter.

6. The waveguide filter of claim 5, wherein the plurality of corrugations and the corrugation interconnect regions are configured to prevent multipaction up to a high applied power of about 1,000,000 W.

7. The waveguide filter of claim 6, wherein the plurality of corrugations and the corrugation interconnect regions are configured to provide improved insertion loss, return loss and rejection parameters over a waveguide filter with parallel plates.

8. The waveguide filter of claim 6, wherein the main cavity and the plurality of corrugations are made of a metal plated with silver, wherein the metal comprises at least one of aluminum, brass, invar or copper.

9. A waveguide filter comprising:

two waveguide interfaces;

a main cavity between the two waveguide interfaces; and a plurality of corrugations having different heights and flaring out of the main cavity, wherein:

corrugation interconnect regions of the main cavity between the plurality of corrugations include inward-sloped surfaces;

at least two sidewalls of the plurality of corrugations are nonparallel;

the inward-sloped surfaces of the corrugation interconnect regions are at an angle with respect to an axis of the main cavity; and the angle is within a range of about 8-28 degrees.

10. The waveguide filter of claim 9, wherein each corrugation of the plurality of corrugations flares out from the main cavity and includes an LIR at an interface with the main cavity and an HIR at an end of the corrugation.

11. The waveguide filter of claim 10, wherein the at least two sidewalls of the plurality of corrugations are at a first angle with respect to an axis of the main cavity, wherein the first angle is greater than 90 degrees and smaller than 180 degrees.

12. The waveguide filter of claim 9, wherein the two waveguide interfaces, the main cavity and the plurality of corrugations are made of a metal from a list comprising at least one of aluminum, brass, invar or copper and are silver-plated.

13. The waveguide filter of claim 9, wherein different heights of the plurality of corrugations reach a maximum height at a midlength of the waveguide filter and are lowest at the two waveguide interfaces.

14. The waveguide filter of claim 9, wherein the plurality of corrugations and the corrugation interconnect regions exclude parallel plates to prevent multipaction up to a high applied power of about 1,000,000 W.

15. A method comprising:

fabricating a first half-structure including a main cavity and a plurality of corrugations;

fabricating a second half-structure similar to the first half-structure; and coupling the first half-structure to the second half-structure to form a compaction-proof waveguide filter, wherein:

the main cavity includes corrugation interconnect regions between the plurality of corrugations;

the corrugation interconnect regions include sloped surfaces;

the plurality of corrugations comprise nonparallel sidewalls;

the sloped surfaces of the corrugation interconnect regions are at an angle with respect to an axis of the main cavity; and the angle is within a range of about 8-28 degrees.

16. The method of claim 15, wherein fabricating the first half-structure includes creating each corrugation of the plurality of corrugations flaring out from the main cavity and having an LIR formed at an interface with the main cavity and an HIR formed at an end of the corrugation.

17. The method of claim 16, wherein fabricating the first half-structure includes creating corrugated sidewalls of the plurality of corrugations having a first angle with respect to an axis of the main cavity, wherein the first angle is greater than 90 degrees and smaller than 180 degrees.

18. The method of claim 17, wherein:

the first half-structure and the second half-structure are made of metal and plated with silvers; and the metal comprises at least one of aluminum, brass, invar or copper.

* * * * *